US010914103B2

(12) United States Patent
Cousin et al.

(10) Patent No.: US 10,914,103 B2
(45) Date of Patent: Feb. 9, 2021

(54) ELECTRONIC HANDLE FOR A VEHICLE DOOR

(71) Applicant: U-Shin Italia S.p.A., Pianezza (IT)

(72) Inventors: Arnaud Cousin, Creteil (FR); Anthony Guerin, Creteil (FR)

(73) Assignee: U-Shin Italia S.p.A., Pianezza (IT)

( * ) Notice: Subject to any disclaimer, the term of this patent is extended or adjusted under 35 U.S.C. 154(b) by 230 days.

(21) Appl. No.: 15/916,490

(22) Filed: Mar. 9, 2018

(65) Prior Publication Data

US 2018/0195320 A1 Jul. 12, 2018

Related U.S. Application Data

(63) Continuation of application No. PCT/EP2016/071236, filed on Sep. 8, 2016.

(30) Foreign Application Priority Data

Sep. 9, 2015 (EP) ..... 15184526

(51) Int. Cl.
*E05B 81/90* (2014.01)
*E05B 81/76* (2014.01)
(Continued)

(52) U.S. Cl.
CPC ..... *E05B 81/90* (2013.01); *E05B 15/0053* (2013.01); *E05B 81/04* (2013.01);
(Continued)

(58) Field of Classification Search
CPC ..... E05B 81/90; E05B 81/04; E05B 81/76; E05B 15/0053; E05B 15/006;
(Continued)

(56) References Cited

U.S. PATENT DOCUMENTS 3,774,420 A * 11/1973 Orr ..... E05B 17/2088 70/104
6,072,403 A * 6/2000 Iwasaki ..... G07C 9/00309 180/287
(Continued)

FOREIGN PATENT DOCUMENTS

DE 102004058874 6/2006
EP 0927803 7/1999
(Continued)

OTHER PUBLICATIONS

International Search Report for International Application PCT/EP2016/071236, dated Nov. 10, 2016.

*Primary Examiner* — Alyson M Merlino
(74) *Attorney, Agent, or Firm* — Burris Law, PLLC

(57) ABSTRACT

The present disclosure relates to a handle for a vehicle door having an activation lever configured for rotating around an activation axis from a rest position to an activation position for activating a latch of the vehicle door, and a bracket intended to receive the activation lever. One of the activation lever and the bracket comprises a driving element, and the other comprises a stop element, the driving element cooperating with the stop element such that when the activation lever is actuated from the rest position to the activation position, the driving element passes from a first side of the stop element corresponding to an initial position, to a second side corresponding to a final position, when the activation lever comes back from the activation position to the rest position, the driving element and the stop element cooperates to make the activation lever come back in the initial position.

18 Claims, 3 Drawing Sheets

(51) Int. Cl.

| | |
|---|---|
| ***E05B 85/16*** | (2014.01) |
| ***E05B 15/00*** | (2006.01) |
| ***E05B 81/04*** | (2014.01) |
| ***E05B 83/36*** | (2014.01) |
| *E05B 17/00* | (2006.01) |

(52) U.S. Cl.
CPC ..... *E05B 81/76* (2013.01); *E05B 83/36* (2013.01); *E05B 85/16* (2013.01); *E05B 17/007* (2013.01)

(58) Field of Classification Search
CPC ..... E05B 15/008; E05B 83/36; E05B 85/16; E05B 17/007; Y10T 292/57; Y10T 292/14
See application file for complete search history.

(56) References Cited

U.S. PATENT DOCUMENTS

| | | | | |
|---|---|---|---|---|
| 6,181,024 | B1 * | 1/2001 | Geil | E05B 85/10 180/287 |
| 8,342,583 | B2 * | 1/2013 | Stauffer | E05B 81/76 292/1 |
| 2001/0005082 | A1 * | 6/2001 | Suparschi | E05B 85/18 292/347 |
| 2008/0084074 | A1 * | 4/2008 | Monig | E05B 81/76 292/201 |

FOREIGN PATENT DOCUMENTS

| | | |
|---|---|---|
| FR | 2802562 | 6/2001 |
| FR | 2802563 | 6/2001 |
| FR | 2953782 | 6/2011 |
| GB | 820352 | 9/1959 |

* cited by examiner

ELECTRONIC HANDLE FOR A VEHICLE DOOR

CROSS-REFERENCE TO RELATED APPLICATIONS

This application is a continuation of International Application No. PCT/EP2016/071236, filed on Sep. 8, 2016, which claims priority to and the benefit of EP 15184526.0 filed on Sep. 9, 2015. The disclosures of the above applications are incorporated herein by reference.

FIELD

The present disclosure relates to an electronic handle for a vehicle door and a vehicle comprising such a handle.

BACKGROUND

The statements in this section merely provide background information related to the present disclosure and may not constitute prior art.

Electronic handles for vehicle doors generally comprise a switch configured to activate a latch mechanism, such as an electronic latch, to unlatch the vehicle door.

Some users prefer having electronic handles with a handle lever configured to be actuated by a user according to a reduced strength with respect to classical mechanical handles, thereby activating the electronic latch mechanism.

Such electronic handles require a battery to be useable. In case of loss of energy in the battery, the electronic handle is not useable and it is not possible for a user to enter the vehicle.

SUMMARY

In one form the present disclosure provides an electronic handle with a mechanical back up in case of loss of battery, which is efficient and easy for the user to activate.

In another form, the present disclosure provides an electronic handle for a vehicle door. The electronic handle includes an electronic device for electronically activating a latch of the vehicle door. Furthermore, the electronic handle also includes an activation lever configured to move along a first stroke to reach an electrical activation position and to move along a second stroke to reach a mechanical activation position in which the activation lever is actuated for activating the latch of the vehicle door in case of a default of the electronic device. The activation lever is further configured for rotating around an activation axis between a rest position in which the activation lever is released and said mechanical activation position. The electronic handle also includes a bracket intended to receive the activation lever, wherein one of the activation lever and the bracket comprises a driving element, and the other comprises a stop element. The driving element cooperates with the stop element such that when the activation lever is actuated from the rest position to the activation position, the driving element passes from a first side of the stop element corresponding to the rest position, to a second side when the activation lever reaches the mechanical activation position, and when the activation lever comes back from the mechanical activation position to the rest position, the driving element and the stop element cooperate to make the activation lever come back to the first side of the stop element.

Advantageously, the electronic handle of the present disclosure enables a mechanical backup for opening the latch since the driving element and the stop element to cooperate for the mechanical activation of the activation lever. Therefore, the handle of the present disclosure has an efficient and easy to use mechanical backup. According to further forms which can be considered alone or in all possible combinations:

the activation lever has an electrical activation position between the rest position and the mechanical activation position, in which the activation lever activates the electronic device for unlatching the door; and/or the stop element is configured to stop the activation lever at the electrical activation position; and/or when the activation lever is moved from the rest position to the activation position by means of a first driving force, the stop element blocks the driving element at the electrical activation position, the driving element at the electrical activation position being in one form placed on the stop element, when the activation lever is moved further to the mechanical activation position by means of a second driving force greater than the first driving force, the driving element passes the stop element and reaches the mechanical activation position, and when the activation lever moves by inertia or by a driving force lower than the first driving force from the mechanical activation position to the rest position, the driving element cooperates with the stop element to make the activation lever come back to the first side of the stop element; and/or the stop element comprises a ramp and the driving element comprises a surface intended to be in contact with the ramp when the activation lever moves from the rest position to the mechanical activation position, the ramp having a straight or a curve surface, such as spherical surface, intended to be in contact with the driving element; and/or the driving element is moveable in translation inside a recess made in the activation lever when the driving element moves from the rest position to the mechanical activation position; and/or the driving element is associated with return driving device; and/or the driving element is a parallelepiped finger, a ball or a cylinder; and/or the stop element is moveable such that the driving element moves the stop element when moving from the mechanical activation position to the rest position; and/or the stop element rotates according to a rotation stopping axis when the driving element moves from the mechanical activation position to the rest position; and/or the stop element is associated with return device, the return device of the stop element having a stiffness inferior to the stiffness of the return driving device; and/or the activation axis of the activation lever is substantially parallel to the stopping axis; and/or the handle comprises a handle lever comprising a column; and/or the activation lever being configured to actuate electronically the latch; and/or the activation lever is configured to actuate a switch of the handle.

Another aspect of the present disclosure relates to a vehicle comprising a door and an electronic handle according to the present disclosure, fixed to the door.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
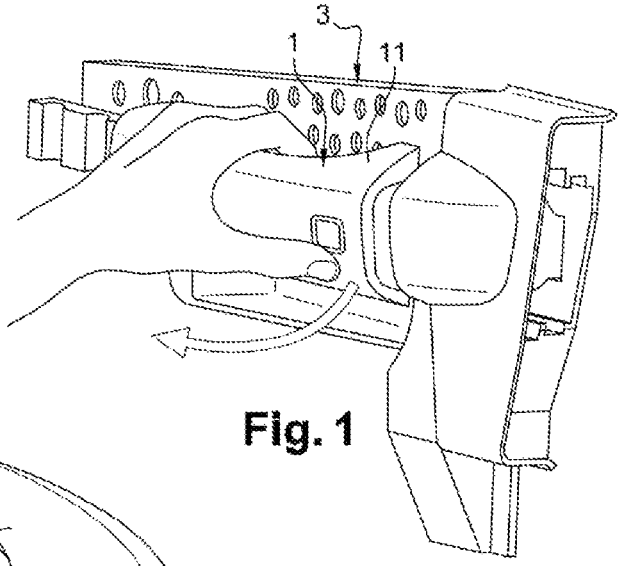
FIG. 1 is a perspective view of an electronic handle according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Referring to FIG. 1, the electronic handle of the present disclosure may comprise a handle lever 1 configured to be fixed in a vehicle door. The handle lever 1 is intended to be mounted on an exterior side of the vehicle door. The handle of the present disclosure may have other types of levers for activating the actuation lever, which are rotatable according to an axis disposed in a different way.

In the present disclosure, the handle lever 1 may comprise a gripping part 11 configured to be grasped by a user, and pulled outwardly with respect to the vehicle door when the user wants to open the door. The handle lever 1 may further comprise a column 12 connected to the gripping part 11 and projecting internally to the vehicle door. The handle further comprises internal parts to be mounted at an interior side of the vehicle door. The internal parts are generally mounted on a bracket 3 such that the bracket 3 supports the internal parts. Another supporting piece may be used with the device of the present disclosure.

Figure 2:
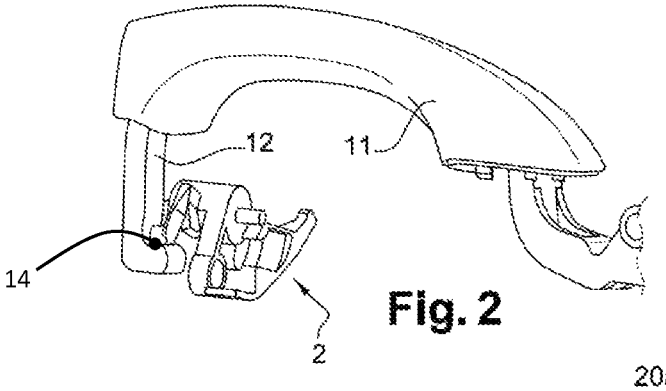
FIG. 2 is perspective view of a handle lever cooperating with an activation lever according to the present disclosure.
Figure 3:
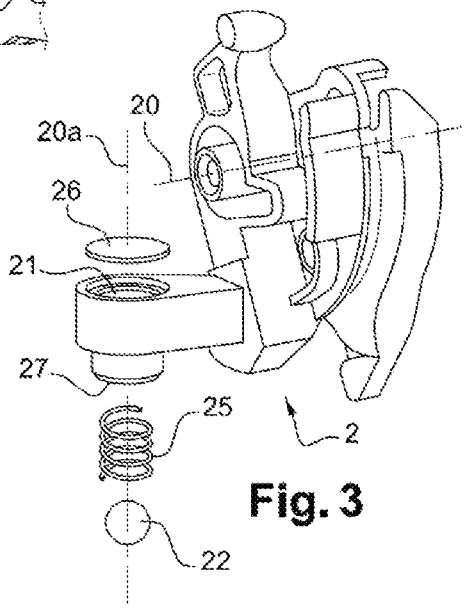
FIG. 3 is a perspective view of an activation lever and of a driving element to be mounted in the activation lever for a handle of a first variation of the present disclosure.
Figure 5:
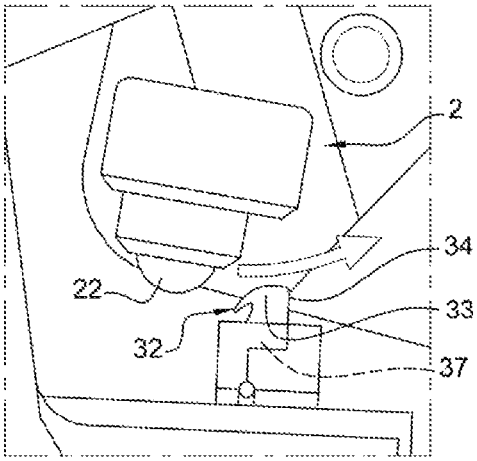
FIG. 5 is a side view of the handle of the first form, in which the activation lever is in a rest position.
Figure 8:
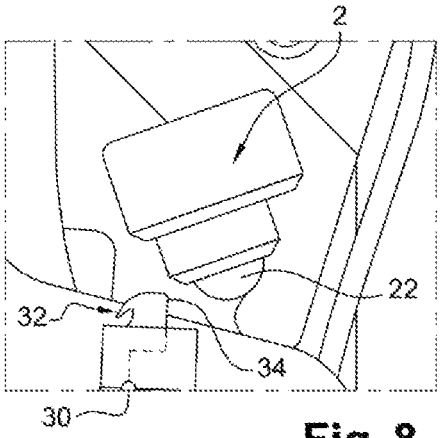
FIG. 8 is a side view of the handle of the first form, in which the activation lever is in a mechanical activation position, in particular for the pulling of a Bowden cable by a mechanical movement.

Among the internal parts is an activation lever 2 cooperating with the handle lever 1 through the column 12 such that when the handle lever 1 is pulled, the handle lever 1 drives the activation lever 2 to move from a rest position to a mechanical activation position for activating a latch for example by pulling mechanically a Bowden cable. The activation lever 2 is rotationally mounted about an activation axis 20. FIG. 2 shows the general aspect of the activation lever 2, and FIG. 3 shows more details. The rest position is shown in FIG. 5 and the mechanical activation position is shown in FIG. 8. In the rest position, the activation lever 2 is released from any actuation.

As an electronic handle, the handle of the present disclosure comprises an electronic device 14 configured to cooperate with a latch. The electronic device 14 is configured to activate the latch through a signal. The latch in turn unlatches the vehicle door.

According to another form, the handle lever 1 and/or the activation lever 2 are configured to electronically actuate the latch, for example by actuating the switch.

The electronic device 14 in one form comprises a switch and a circuit configured for example such that when the switch is closed, electric current flows and activates the latch.

The activation lever 2 further has an electrical activation position between the rest position and the mechanical activation position, in which the activation lever activates the electronic device 14 for unlatching the door. The electronic device 14, in particular, is a switch that may be provided on the activation lever 2 and/or on the handle lever 11. The electronic device 14 can also be in contact with a surface of the activation lever 2 or in contact with a moving element of the handle connected to the activation lever 2 and/or the handle lever 11.

Alternatively, to the switch, a hall-effect device or a sensor may be used as an electronic device 14 to command the latch.

According to another form, the handle lever 1 and/or the activation lever 2 may actuate the electronic device 14 such as the switch, the hall-effect device or the sensor.

According to one form, the activation lever 2 may be configured to move along a first stroke, which in one form is a short stroke, to reach the electrical activation position. The activation lever 2 is further configured to move along a second stroke, which in one form is a long stroke, to reach the mechanical activation position. The mechanical activation position is in one form beyond the electrical activation position, and in one form with the same orientation thereof, with reference to the rest position.

According to a first form of the present disclosure, the activation lever 2 comprises a driving element 22, and the bracket 3 comprises a stop element 32, and the driving element 22 cooperates with the stop element 32 during their respective movements. More specifically, when the activation lever 2 is actuated from the rest position to the mechanical activation position, the driving element 22 passes from a first side of the stop element 32 corresponding to an initial position, to a second side when the activation lever 2 reaches the mechanical activation position corresponding to a final position. When the activation lever comes back from the mechanical activation position to the rest position, the driving element 22 and the stop element 32 cooperate for coming back in the initial position to the first side of the stop element 32.

Figure 6:
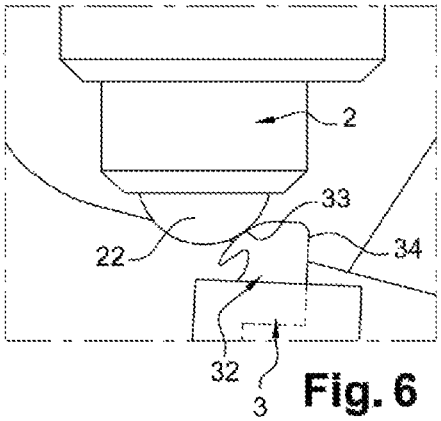
FIG. 6 is a perspective view of the handle of the first form, in which the activation lever is blocked in an intermediate position.

The handle of the present disclosure enables having an improved mechanical backup in particular for electronic handles since the driving element 22 and the stop element 32 cooperate together such that the activation lever 2 can reach the mechanical activation position and unlatch the door. The handle may be configured such that when the activation lever 2 is moved from the rest position to the electrical activation position by means of a first driving force, the stop element 32 blocks the driving element 22 in an intermediate position between the initial and positions, and shown in FIG. 6. The driving element 22 in the intermediate position may be placed on the stop element 32.

Figure 7:
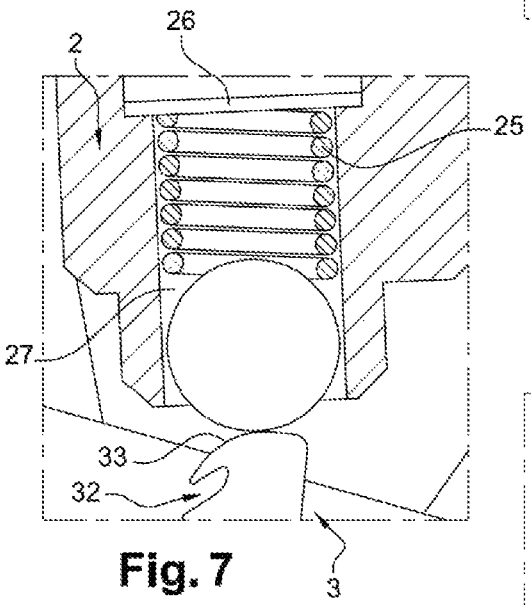
FIG. 7 is a perspective view of the handle of the first form, in which the driving element is passing the stop element and the activation lever partially cut out.

Moreover, when the activation lever 2 is moved further to the mechanical activation position by means of a second driving force greater than the first driving force, the driving element 22 passes the stop element 32 as shown in FIG. 7. The driving element 22 then reaches the mechanical activation position.

In addition, when the activation lever 2 moves by inertia or by a driving force lower than the first driving force from the mechanical activation position to the rest position, the driving element 22 cooperates with the stop element 32 for coming back to the rest position.

Advantageously, the handle of the present disclosure enables to have an intermediate blocking position when the handle lever is pulled with the first driving force. This intermediate blocking position corresponds to the electrical activation of the electronic latch in particular by the activation lever 2, and to a position of the handle lever 1 as shown in FIG. 1. In this position, the activation is made by the activation lever associated to a switch, for example.

Figure 4:
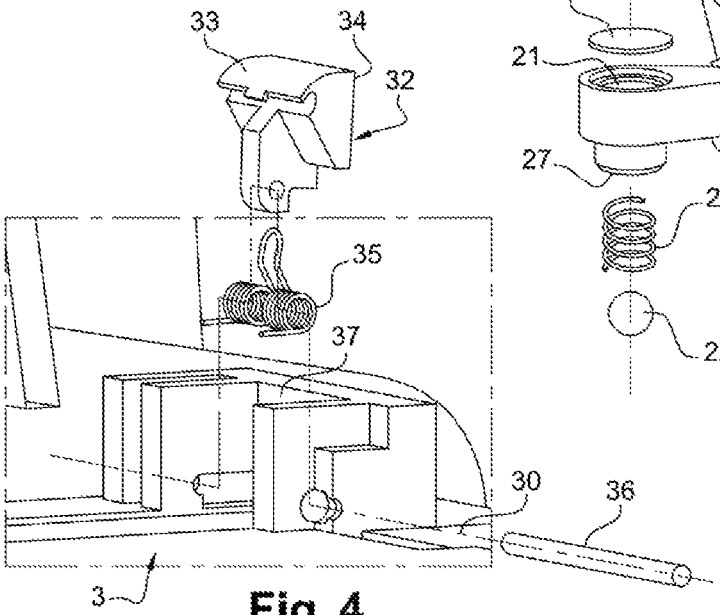
FIG. 4 is a perspective view of a stop element to be mounted in a bracket for the handle of the first form of the present disclosure.

Referring to FIG. 4, the stop element 32 comprises a ramp 33 and the driving element 22 comprises a surface intended to be in contact with the ramp 33 when the activation lever 2 moves from the rest position to the mechanical activation position. The ramp 33 has a straight or a curve surface, such as spherical surface, in contact with the driving element 22.

Advantageously, when the driving element 22 is moving in contact with the ramp 33 in order to pass the stop element 32, the handle needs an increased driving force. More particularly, the ramp 33 has a partial cylindrical shape. Advantageously, a partial cylindrical shape enables to have wide stopping zone maintained effective even if the activation lever 2 has a play in the direction of the driving axis 20, i.e. is moved inwardly or outwardly with respect to the plane of FIGS. 5 to 9A.

The ramp 33 could also have an angular form two slopes.

The ramp 33 is placed at the first side of the stop element 32, and is configured to stop the driving element 22 when the activation lever 2 is actuated with the first driving force. This position is the one used to activate the electronic latch. When the activation lever 2 is actuated with the second driving force, the driving element 22 is moved on the surface of the ramp such that the driving element 22 passes the stop element 32 and the activation lever 2 reaches the mechanical activation position. This position is the one used to activate the mechanical backup.

The driving element 22 is moveable in translation inside a recess 21 made in the activation lever 2 when the driving element 22 moves from the rest position to the mechanical activation position. Advantageously, the driving element 22 may be pushed by the ramp 33 inside the said recess 21 such that the driving element 22 passes the stop element 32.

To this end, the driving element 22 is translationally mounted about a projecting direction 20*a*, to move between a projecting position and a retracted position. The projecting direction 20*a* is substantially perpendicular to the movement of the driving element 22 from the rest position to the mechanical activation position. The projecting direction is in one form secant to the activation axis 20. More particularly, in one form, the projecting direction is substantially perpendicular to the activation axis 20.

In the projecting position, the driving element 22 is projected in a centrifuge direction with respect to the activation axis 20 and contacts the stop element 32. In the retracted position, the driving element 22 is moved in a centripetal direction and is retracted with respect to the stop element 32. The projecting direction is adapted to the inclination of the ramp 33.

The recess 21 comprises a projecting stop 27 limiting the displacement of the driving element 22 at the projecting position.

The driving element 22 is associated with return driving device 25, for example a compression spring.

The return driving device 25 is supported by a base plate 26, which is here a separate part of and fixable at the bottom of the recess 21. In another form, the base plate may be a part of the activation lever and/or of the above mentioned recess. The return driving device 25 is configured to urge the driving element 22 towards the projecting position. Advantageously, the return driving device 25 enables an automatic mechanical returning of the driving element 22 to the projecting position.

Moreover, in the arrangement of the present disclosure, the force of the return driving device 25 determines if the driving element will pass the stop element 32 depending on the driving forces actuating the activation lever 2. Thus, advantageously, the return driving device 25 enable to calibrate the required force intensities for the first and second driving forces.

The driving element 22 is a ball or a cylinder. Advantageously, the driving element 22 has a continuous curved surface and is configured to roll on the ramp 33. A cylinder driving element may be made of a plastic or a metallic material.

Advantageously, a rolling ball or a rolling cylinder limits the frictional forces when the driving element 22 is moving on the stop element 32.

The driving element 22 may also slide on the ramp 33.

The driving element 22 may have the surface intended to be in contact with the ramp covered by a layer reducing the friction between the driving element and the stop element. According to an alternative form, the driving element 22 is a parallelepiped finger.

Figure 9:
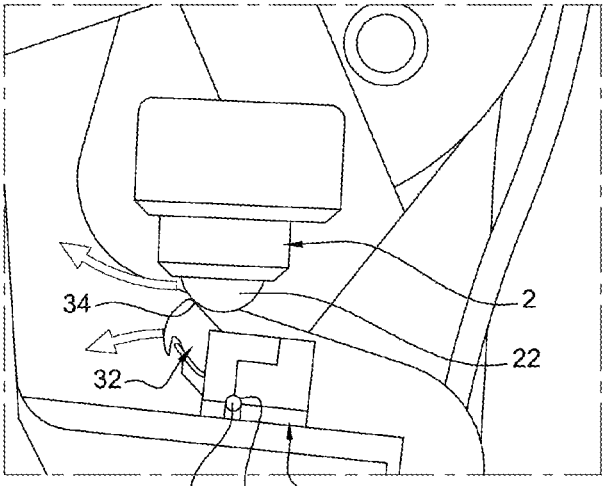
FIG. 9 is a side view of the handle of the first form, in which the activation lever is returning from the mechanical activation position to the rest position.

The stop element 32 is moveable such that the driving element 22 moves the stop element 32 when moving from the mechanical activation position to the rest position. To this end, the stop element 32 is moveably mounted between a blocking position and a releasing position. In the blocking position, the stop element 32 is placed such that the ramp 33 blocks the driving element 22 moving from the rest position to the mechanical activation position due to the first driving force. In the releasing position, the stop element 32 is moved by the driven element 22 such that the activation lever 2 may return to the rest position. The releasing position is shown in FIG. 9.

Advantageously, due to the moveable stop element 32, the activation lever 2 is not blocked by the stop element 32 when returning to the rest position. The handle comprises a blocking wall 37 associated with the stop element 32. The blocking wall 37 for blocks the movement of the stop element 32 when the driving element 22 passes from the rest position to the mechanical activation position.

Advantageously, the blocking wall 37 cooperates with the stop element 32 to maintain the stop element 32 in the blocking position even if a high second driving force is applied.

The stop element 32 may rotate according to a rotation stopping axis 30 when the driving element 22 moves from the mechanical activation position to the rest position. The rotation movement enables a simple displacement of the stop element 32 by a rotating driving element 22. To this end, the stop element 32 is supported by a pin 36 extending along the stopping axis 30. The stop element 32 may be associated with return device 35, such as a cylindrical spring. The return mechanism device 35 of the stop element 32 have a stiffness inferior to the stiffness of the return driving device 25.

Advantageously, the return device 35 enables an automatic mechanical returning of the stop element 32 to the blocking position. In addition, the return device 35 enables the stop element 32 to be moved towards the releasing position. In one form, the return device 35 of the stop element 32 has a stiffness inferior to the stiffness of an activation return device urging the activation lever 2 towards the rest position. The stop element 32 may have a releasing part 34 on a second side. The releasing part 34 is substantially perpendicular to the movement of the driving element 22 from the mechanical activation position to the rest position.

A low stiffness of the return device 25 and a right surface of the releasing part 34 enable to have the activation lever 2 return to the rest position by releasing the handle lever 1 without having to forcefully drive the activation lever 2 towards the rest position. Advantageously, the return device 35 enables to calibrate the required force intensities for the returning of the activation lever 2 to the rest position. The activation axis 20 of the activation lever 2 may be substantially parallel to the stopping axis 30.

Advantageously, substantially parallel activation 20 and stopping 30 axes simplifies further the displacement of the stop element 32 pushed by the driving element 22 and involves a gain of space. Indeed, the movements of the stop element 32 and of the driving element 22 can be coplanar. The first variation has the advantage of being adequate for the high space for the stop element 32 on the bracket 3 and the low space for the driving element 22 of the activation lever 2, as there is more space on the bracket 3 than on the activation lever 2.

Figure 10:
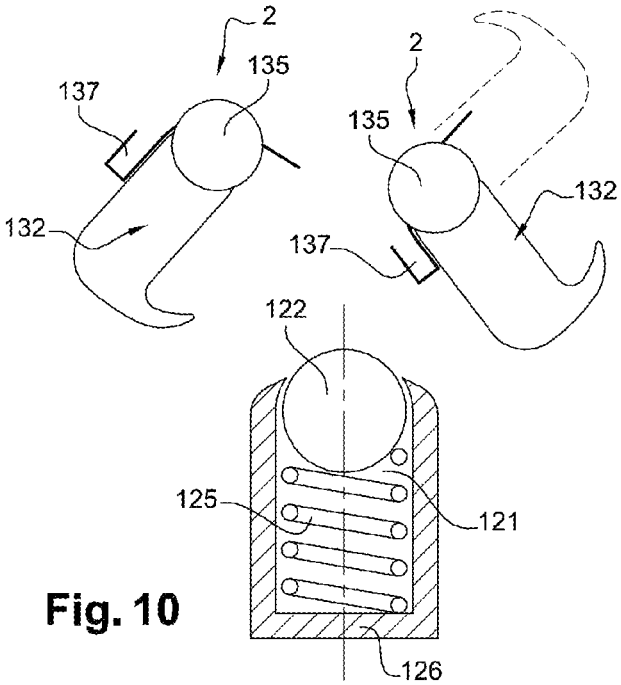
FIG. 10 is a side view of the handle of a second form of the present disclosure.

FIG. 10 shows an alternative form of the handle of the present disclosure, where the stop element 132 is on the activation lever 2 and the driving element 122 is on the bracket 3.

As shown in FIG. 10, the blocking wall 137 and the blocking return device 135 are also on the activation lever 2. Moreover, the recess 121, the base plate 126 and the return driving device 125 are also on the bracket 3. The base plate 126 is here part of the recess 121.

In FIG. 10, the rest position is shown on the left and the mechanical activation position is shown on the right. The dashed points represent the releasing position of the stop element 132. The second embodiment is similar to the first embodiment. The stop element 132 blocks the activation lever 2 in cooperation with the driving element 122.

The electronic latch is configured to be activated, through the electronic device 14, by actuating the handle lever with the first driving force. In case of loss of electrical energy, the handle lever may be actuated by means of the second driving force higher than the first driving force so as to enable the activation lever 2 to reach the mechanical activating position and in particular pulling the Bowden cable connected to the latch.

The activation lever 2 may then return to the rest position without being blocked by the stop element 32, due to the arrangement of the present disclosure.

Advantageously, the electronic handle of the present disclosure enables a good mechanical back-up, with a design applicable on standard activation lever of the prior art.

In addition, the present disclosure may be implemented both on a horizontal and a vertical lever arrangement, with respect to the orientation of the corresponding vehicle.

Furthermore, the present disclosure has a reversible configuration allowing to open the latch many times, for example in case of losses of energy contrary to the prior solutions that are useable only once.

The solution is ergonomic and friendly as the user have to do a standard handle pulling movement, contrary to the prior complex solutions to be checked within a technical manual.

Many modifications and variations will suggest themselves to those skilled in the art upon making reference to the foregoing illustrative forms, which are given by way of example only and which are not intended to limit the scope of the present disclosure, that being determined solely by the appended claims.

In the claims, the word "comprising" does not exclude other elements or steps, and the indefinite article "a" or "an" does not exclude a plurality. The mere fact that different features are recited in mutually different dependent claims does not indicate that a combination of these features cannot be advantageously used. Any reference signs in the claims should not be construed as limiting the scope of the present disclosure.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. An electronic handle for a vehicle door, the electronic handle comprising:

an electronic device for electronically activating a latch of the vehicle door;

an activation lever configured to be rotated around an activation axis by a handle lever along a first stroke to reach an electrical activation position, in which the electronic device electronically activates the latch, and to be rotated along a second stroke to reach a mechanical activation position, in which the latch is mechanically activated, wherein the activation lever is rotated by the handle lever for mechanically activating the latch of the vehicle door in case of a default of the electronic activation of the latch by the electronic device, and the activation lever being further configured for rotating around the activation axis between a rest position, in which the activation lever is released from any actuation, and said mechanical activation position; and a bracket intended to receive the activation lever, wherein one of the activation lever and the bracket comprises a driving element, and the other comprises a stop element, the driving element cooperating with the stop element such that when the activation lever is rotated from the rest position to the mechanical activation position, the driving element passes from a first side of the stop element corresponding to the rest position, to a second side when the activation lever reaches the mechanical activation position, when the activation lever comes back from the mechanical activation position to the rest position, the driving element and the stop element cooperate to allow the activation lever come back to the first side of the stop element, wherein the stop element is rotatable according to a rotation stopping axis such that the driving element rotates the stop element when the activation lever rotates from the mechanical activation position to the rest position.

2. The electronic handle according to claim 1, wherein the electrical activation position of the activation lever is between the rest position and the mechanical activation position, wherein the activation lever activates the electronic device for unlatching the latch of the vehicle door when in the electrical activation position.

3. The electronic handle according to claim 1, wherein the stop element comprises a ramp and the driving element comprises a surface configured to be in contact with the ramp when the activation lever rotates from the rest position to the mechanical activation position, wherein the ramp has at least one of a straight or a curved surface, configured to be in contact with the driving element.

4. The electronic handle according to claim 1, wherein the driving element is associated with a return driving device.

5. The electronic handle according to claim 1, wherein the stop element is associated with a return device, and the return device of the stop element has a stiffness inferior to the stiffness of a return driving device associated with the driving element.

6. The electronic handle according to claim 1, wherein the activation axis of the activation lever is substantially parallel to the rotation stopping axis.

7. An electronic handle for a vehicle door, the electronic handle comprising:

an electronic device for electronically activating a latch of the vehicle door;

an activation lever configured to be rotated around an activation axis by a handle lever along a first stroke to reach an electrical activation position, in which the electronic device electronically activates the latch, and to be rotated along a second stroke to reach a mechanical activation position, in which the latch is mechanically activated, wherein the activation lever is rotated by the handle lever for mechanically activating the latch of the vehicle door in case of a default of the electronic activation of the latch by the electronic device, and the activation lever being further configured for rotating around the activation axis between a rest position, in which the activation lever is released from any actuation, and said mechanical activation position; and a bracket intended to receive the activation lever, wherein one of the activation lever and the bracket comprises a driving element, and the other comprises a stop element, the driving element cooperating with the stop element such that when the activation lever is rotated from the rest position to the mechanical activation position, the driving element passes from a first side of the stop element corresponding to the rest position, to a second side when the activation lever reaches the mechanical activation position, when the activation lever comes back from the mechanical activation position to the rest position, the driving element and the stop element cooperate to allow the activation lever come back to the first side of the stop element, wherein the stop element is configured to stop the activation lever at the electrical activation position, wherein when the activation lever is rotated from the rest position to the mechanical activation position by means of a first driving force, the stop element blocks the driving element at the electrical activation position, wherein the driving element at the electrical activation position is placed on the stop element; and wherein when the activation lever is rotated to the mechanical activation position by means of a second driving force greater than the first driving force, the driving element passes the stop element and reaches the mechanical activation position, and wherein when the activation lever rotates by inertia or by a driving force lower than the first driving force from the mechanical activation position to the rest position, the driving element cooperates with the stop element to allow the activation lever come back to the first side of the stop element.

8. The electronic handle according to claim 7, wherein the electrical activation position of the activation lever is between the rest position and the mechanical activation position, wherein the activation lever activates the electronic device for unlatching the latch of the vehicle door when in the electrical activation position.

9. The electronic handle according to claim 7, wherein the stop element comprises a ramp and the driving element comprises a surface configured to be in contact with the ramp when the activation lever rotates from the rest position to the mechanical activation position, wherein the ramp has at least one of a straight or a curved surface, configured to be in contact with the driving element.

10. The electronic handle according to claim 7, wherein the driving element is associated with a return driving device.

11. The electronic handle according to claim 7, wherein the stop element is associated with a return device, and the return device of the stop element has a stiffness inferior to the stiffness of a return driving device associated with the driving element.

12. The electronic handle according to claim 7, wherein the activation axis of the activation lever is substantially parallel to the stopping axis of the stop element.

13. An electronic handle for a vehicle door, the electronic handle comprising:

an electronic device for electronically activating a latch of the vehicle door;

an activation lever configured to be rotated around an activation axis by a handle lever along a first stroke from a rest position to reach an electrical activation position, in which the electronic device electronically activates the latch, and to be moved along a second stroke to reach a mechanical activation position, in which the latch is mechanically activated, the activation lever cooperating with the handle lever through a column such that:

in the rest position, the activation lever is released from any actuation, when the handle lever is pulled, the handle lever rotates about an axis that is different than the activation axis and drives the activation lever to rotate from the rest position to the mechanical activation position for mechanically activating the latch, wherein the activation lever is rotated by the handle lever for mechanically activating the latch of the vehicle door in case of a default of the electronic activation of the latch by the electronic device; and a bracket intended to receive the activation lever, wherein the activation lever comprises a driving element, and the bracket comprises a stop element, the driving element cooperating with the stop element such that when the activation lever is rotated from the rest position to the mechanical activation position, the driving element passes from a first side of the stop element corresponding to the rest position, to a second side when the activation lever reaches the mechanical activation position, when the activation lever comes back from the mechanical activation position to the rest position, the driving element and the stop element cooperate to allow the activation lever come back to the first side of the stop element, wherein the driving element is moveable in translation inside a recess made in the activation lever when the activation lever rotates from the rest position to the mechanical activation position.

14. The electronic handle according to claim 13, wherein the electrical activation position of the activation lever is between the rest position and the mechanical activation position, wherein the activation lever activates the electronic device for unlatching the latch of the vehicle door when in the electrical activation position.

15. The electronic handle according to claim 13, wherein the stop element comprises a ramp and the driving element comprises a surface configured to be in contact with the ramp when the activation lever rotates from the rest position to the mechanical activation position, wherein the ramp has at least one of a straight or a curved surface, configured to be in contact with the driving element.

16. The electronic handle according to claim 13, wherein the driving element is associated with a return driving device.

17. The electronic handle according to claim 13, wherein the stop element is associated with a return device, and the return device of the stop element has a stiffness inferior to the stiffness of a return driving device associated with the driving element.

18. The electronic handle according to claim 13, wherein the activation axis of the activation lever is substantially parallel to the stopping axis of the stop element.

* * * * *